United States Patent [19]

Petkovsek

[11] Patent Number: 4,800,931

[45] Date of Patent: Jan. 31, 1989

[54] COMBINATION PRESSURE PRODUCING AND EVACUATION TESTING DEVICE

[76] Inventor: Stephen Petkovsek, 828 Woodbine Cir., Lake Zurich, Ill. 60047

[21] Appl. No.: 7,948

[22] Filed: Jan. 28, 1987

[51] Int. Cl.[4] ..... B65B 31/04

[52] U.S. Cl. ..... 141/65; 141/83; 141/98; 73/714; 73/744

[58] Field of Search ..... 141/1-12, 141/37-67, 83, 98, 250-262; 73/714, 756, 744, 40, 46

[56] References Cited

U.S. PATENT DOCUMENTS

| | | | |
|---|---|---|---|
| 4,583,925 | 4/1986 | Hawkins | 141/65 X |
| 4,615,361 | 10/1986 | Bartle, Sr. | 141/65 |
| 4,651,570 | 3/1987 | Rosaen | 73/744 |
| 4,699,190 | 10/1987 | Bates | 141/65 |
| 4,745,730 | 5/1988 | Bartle, Sr. | 141/65 |

*Primary Examiner*—Henry J. Recla
*Assistant Examiner*—Ernest G. Cusick
*Attorney, Agent, or Firm*—Wood, Dalton, Phillips, Mason & Rowe

[57] ABSTRACT

According to the invention, a single structure is provided to both produce pressure in and evacuate a space. The inventive device has a barrel with a chamber and separate vacuum and pressure passageways in communication with the chamber. A check valve is mounted in the vacuum passageway to permit flow of air into the chamber through the vacuum passageway but to prohibit flow out of the chamber through the vacuum passageway. A second check valve is mounted in the pressure passageway to permit flow of air out of the chamber through the pressure passageway but to prohibit passage of air through the passageway into the chamber. A plunger is movably mounted in the chamber to selectively develop pressure in the chamber and pressure passageway upon being moved in a first direction and to draw air from the chamber and evacuate the vacuum passageway upon being moved opposite to the first direction.

10 Claims, 1 Drawing Sheet

COMBINATION PRESSURE PRODUCING AND EVACUATION TESTING DEVICE

BACKGROUND OF THE INVENTION

1. Field of the Invention

This invention relates to engine test equipment and, more particularly, to a single device that is capable of selectively producing pressure in and evacuating a space.

2. Background Art

In gasoline powered engines, compression of a fuel-/air mixture takes place in a crank case. To optimize engine performance, the crank case is tightly sealed. A leaking crank case may result in power loss and/or fuel leakage.

To test for proper sealing of a crank case, generally two types of tests are performed. The first of these, a pressure test, is carried out after first removing the spark plug, carburetor and muffler and sealingly covering the ports through which theses parts communicate with the inside of the crank case. A special fitting is threaded into the spark plug opening and has an adapter to accept a conduit. A predetermined pressure is developed in the crank case by a pump which forces air through the conduit attached to the spark plug fitting. The existence of leaks can be detected if the crank case will not maintain the predetermined pressure.

In some instances, crank case seals will withstand forces developed in a pressure test, yet will fail to block the entry of external air with the crank case evacuated. Accordingly, it is a general practice to perform both pressure and vacuum tests. The vacuum test is conducted in much the same manner as the pressure test, however an evacuating device is used instead of the pressure producing device.

As a general rule, separate evacuating and pressure producing devices are utilized in performing the separate tests, requiring one to keep both devices on hand at all times. From a user's standpoint, it is expensive and inconvenient to have to purchase and handle two separate devices.

SUMMARY OF THE INVENTION

The present invention is specifically directed to overcoming the above enumerated problems in a novel and simple manner.

According to the invention, a single structure is provided to both produce pressure in and evacuate a space. The inventive device has a barrel with a chamber and separate vacuum and pressure passageways in communication with the chamber. A check valve is mounted in the vacuum passageway to permit flow of air into the chamber through the vacuum passageway but to prohibit flow out of the chamber through the vacuum passageway. A second check valve is mounted in the pressure passageway to permit flow of air out of the chamber through the pressure passageway but to prohibit passage of air through the passageway into the chamber. A plunger is movably mounted in the chamber to selectively develop pressure in the chamber and pressure passageway upon being moved in a first direction and to draw air from the chamber and evacuate the vacuum passageway upon being moved opposite to the first direction.

Accordingly, by simply manipulating the plunger, one can selectively develop pressure in and evacuate a space with a single, simple device.

To ascertain the amount of pressure and vacuum developed by the plunger, gauges are mounted directly on the barrel in communication with the vacuum and pressure passageways.

In a preferred form, the barrel and plunger are molded from a plastic material.

Overall, the inventive structure is compact, versatile, yet simple and inexpensive to construct. From a manufacturing standpoint, the need to construct and separately inventory two different devices is obviated.

DETAILED DESCRIPTION OF THE DRAWINGS

Figure 1:
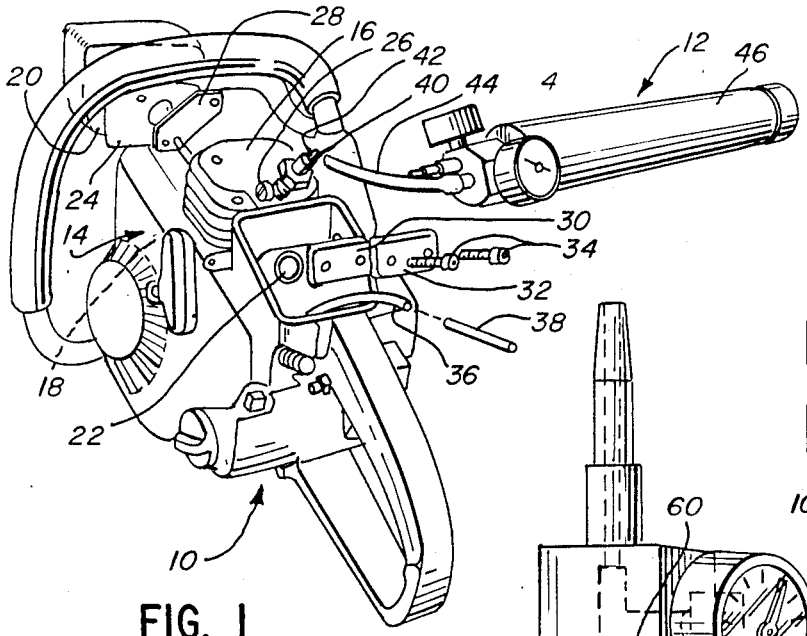
FIG. 1 is a perspective view of a conventional two cycle chain saw with the inventive pressure producing and evacuation device situated to conduct either a pressure or vacuum test.
Figure 4:
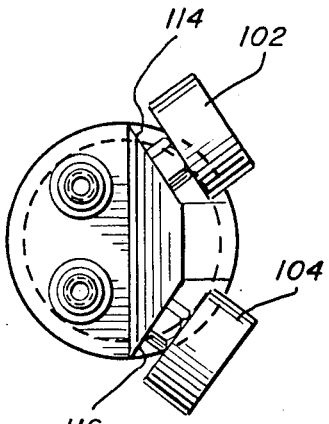
FIG. 4 is a top view of the inventive device.
Figure 5:
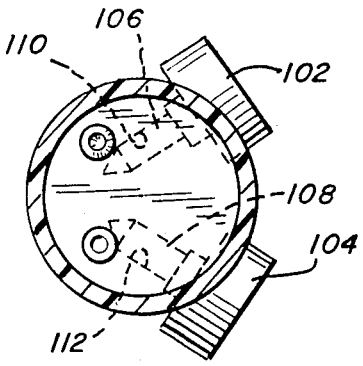
FIG. 5 is a sectional view of the inventive device taken along line 5—5 of FIG. 2.
Figure 2:
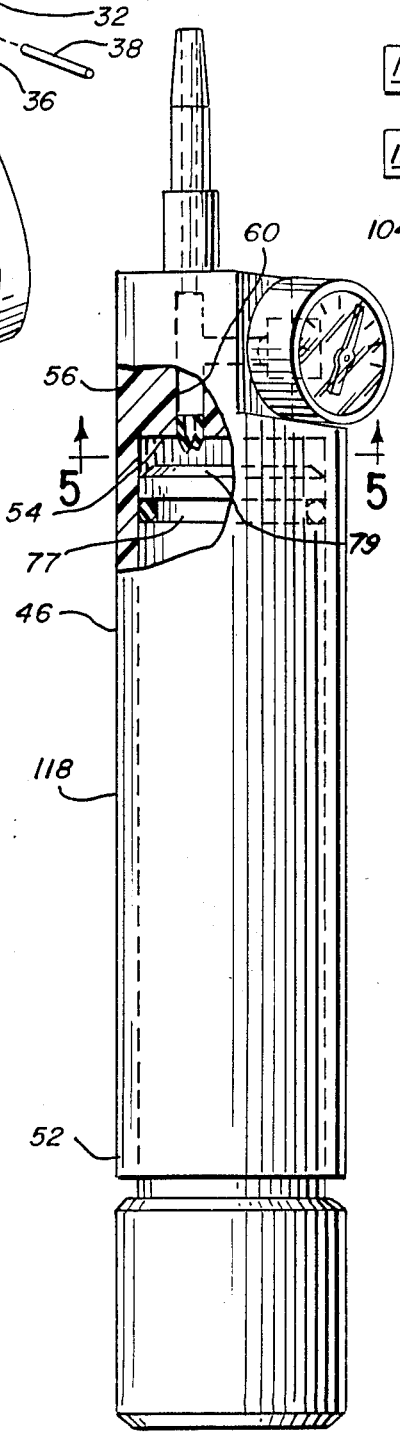
FIG. 2 is a side elevation view of the inventive device.

In FIG. 1, a chain saw with a two cycle engine is shown at 10 with the inventive pressure producing and evacuation device at 12, according to the invention, situated for the performance selectively of either a vacuum or pressure test. Testing for crank case sealing on a two cycle engine is but exemplary of many applications for the present device. For example, the device can be used to test for leakage in stern drives for marine equipment, in automobile engines, in plumbing systems, vacuum circuits, etc.

The chain saw depicted in FIG. 1 is a conventional type construction and has a chain driving motor at 14, with an upright cylinder 16. The engine crank case 18, which is to be seal tested, communicates through an opening (not shown) with a muffler 20. An intake port 22 is proivded at the rear of the cylinder 16.

To initiate a test, the muffler and an associated gasket 24 are removed from the front of the cylinder. The air cleaner cover, air filter and carburetor (not shown) are removed from the rear of the engine to expose the intake aperture 22. Finally, the spark plug (not shown) is removed from a threaded opening 26 in the top of the cylinder 16. A resilient rubber plug 28 is attached sealingly over the front cylinder opening. A similar rubber plug 30 is placed over the intake aperture 22 and secured sealingly in place by an overlying metal plate 32 and bolts 34. A pipe 36 is sealed off by a closely fitting plug 38. An adapter 40 is threaded into the spark plug opening 26 in place of the spark plug and has an associated fitting 42 to mount a flexible conduit 44, through which the crank case can either be pressurized or evacuated using the device 12.

Turning now to the inventive device 12, a cylindrical barrel 46 is provided and has an axial bore defining a chamber 48, bounded by a cylindrical surface 50. The chamber 48 is open at one axial end 52 of the barrel and is bounded by a wall 54 at the opposite end 56 of the barrel.

The barrel 46 has an axially extending pressure passageway 58 and an axially extending vacuum passageway 60. Each of the pressure and vacuum passageways 58, 60 is in communication with the chamber 48 and has an outlet end 62, 64 respectively. A check valve 66 is mounted in the vacuum passageway 60 to allow passage of air through the passageway into the chamber but to prohibit passage of air from the chamber into the passageway 60. Check valves suitable for this purpose are well known in the art. A similar check valve 68 is provided in the pressure passageway 58 and is reversed in an axial direction so that air can pass from the chamber 48 into the pressure passageway 58 but flow of air from the passageway 58 into the chamber 48 is prohibited.

A cylindrical plunger 70 is fit through the open end 52 of the chamber and has an outer surface 72 that fits closely against the inside surface 50 bounding the chamber 48. To assure that close, sealing engagement is made between the outer surface 72 of the plunger 70 and the inside surface 50 of the barrel, a circumferential groove 74 is defined in the plunger to accept an O-ring 76, which is sealingly compressed between the bottom groove surface 77 and surface 50 upon the plunger being inserted into the barrel. The leading end 78 of the plunger 70 has a flat surface 80 facing the wall 54 and a chamfer 79 to facilitate entry of the plunger into the barrel chamber. The opposite end 82 of the plunger 70 has an enlarged head 84 which can be comfortably grasped by a user to manipulate the plunger and defines a shoulder 86 to abut the free edge 88 at the end 52 of the barrel to limit insertion of the plunger 70 into the barrel.

Upon the plunger 70 being forced into the chamber 48, the size of chamber 48 is reduced and air pressure increases both in the chamber 48 and the pressure passageway 58. Withdrawal of the plunger 70 draws air with it and in so doing evacuates the vacuum passageway 60.

To utilize the vacuum and pressure buildup, hollow fittings, 90, 92 are provided on the barrel in communication with the pressure passageway 58 and vacuum passageway 60 respectively. Each of the fittings 90, 92 has a stepped outer surface 94, 96 to closely accept conduits 98, 100 having a range of inside diameters. Each of the free ends 100, 102 of the fittings has tapered diameter to facilitate their entry into the conduits 98, 100.

To perform the pressure and vacuum tests, one selectively attaches either the conduit 98 or conduit 100, communicating with the pressure passageway 58 and vacuum passageway 60 respectively, to the fitting 42 on the adapter 40 in the spark plug opening 26. The plunger can then be reciprocated axially within the chamber 48 through the head 84 until the desired vacuum or pressure buildup is produced.

Figure 3:
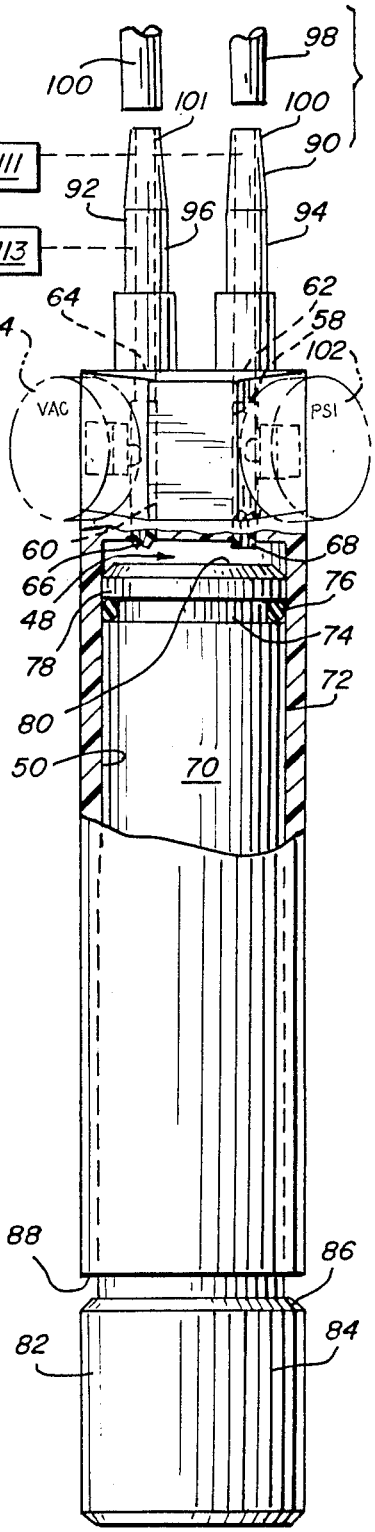
FIG. 3 is a front elevation view of the inventive device.

To ascertain the developed amount of vacuum or pressure, a pressure gauge 102 and vacuum gauge 104 are rigidly mounted directly to the barrel. Each of the pressure gauges has an associated stem 106, 108 threaded into radially extending bores 110, 112 in the barrel, which extend into communication with the passageways 58, 60. Relief valves 111, 113, shown schematically in FIG. 3, can be provided in communication with the pressure and vacuum passageway 58, 60 respectively to equalize the pressure between the passageways 58, 60 and outside air.

To facilitate assembly of the gauges 102, 104, and to reduce the overall dimension of the device 12, flats 114, 116 are formed in the generally cylindrical, outer surface 118 of the barrel 46.

To simplify and reduce the cost of constructing the device 12 and to make the device light in weight, the barrel and plunger are injection molded with polypropylene. The fittings 90, 92 can be integrally formed with the barrel or separately attached.

It can be seen that a simple yet versatile structure is provided according to the invention. Pressure producing and evacuation capabilities of the device can be simply controlled by varying the plunger size.

I claim:

1. A combination pressure producing and evacuation device comprising:

a barrel having a chamber;

a vacuum passageway in said barrel in communication with said chamber and having an outlet;

a pressure passageway in said barrel in communication with said chamber and having an outlet;

a first flow control means in said barrel to allow passage of air into said chamber through said vacuum passageway and to prevent passage of air in said chamber outwardly through said vacuum passageway;

a second flow control means in said barrel to allow passage of air in said chamber outwardly through said pressure passageway and to prevent passage of air into said chamber through said pressure passageway;

a plunger;

means mounting the plunger at least partially within said chamber for selective movement in a first direction to compress air in the chamber and pressure passageway and in a second direction to draw air in the chamber away from the vacuum passageway to evacuate the vacuum passageway;

means outside of said chamber to be grasped by the hand of a user for moving the plunger selectively in said first and second directions;

a pressure gauge;

means mounting the pressure gauge rigidly on the barrel to establish communication between said pressure gauge and pressure passageway so that the amount of pressure in said pressure passageway can be ascertained;

a vacuum gauge;

means mounting the vacuum gauge rigidly on the barrel to establish communication between said vacuum gauge and vacuum passageway so that the amount of vacuum in the vacuum passageway can be ascertained.

2. The combination pressure and evacuation device according to claim 1 wherein said moving means comprises an integral head on said plunger that can be directly grasped by a user to manually move the plunger in said first and second directions.

3. The combination pressure and evacuation device according to claim 1 wherein the plunger mounting means mount the plunger removably within said chamber.

4. A combination pressure producing and evacuation device comprising:

a barrel having a cylindrical bore defining a chamber with an open end and a wall surface bounding the chamber;

a vacuum passageway in said barrel in communication with said chamber and having an outlet;

a pressure passageway in said barrel in communication with said chamber and having an outlet;

a first flow control means to allow passage of air into said chamber through said vacuum passageway and to prevent passage of air in said chamber outwardly through said vacuum passageway;

a second flow control means to allow passage of air in said chamber outwardly through said pressure passageway and to prevent passage of air into said chamber through said pressure passageway;

a plunger having a cylindrical surface;

means removably mounting the plunger in the open end of the barrel so that the plunger surface sealingly engages the barrel wall surface and so that the plunger is movable in a first direction relative to the barrel to reduce the chamber size and thereby build pressure in the pressure passageway and in a second direction relative to the barrel to increase the chamber size and evacuate the vacuum passageway;

means outside of said chamber to be grasped by the hand of a user for moving the plunger selectively in said first and second directions;

a pressure gauge;

means mounting the pressure gauge rigidly to the barrel to establish communication between said pressure gauge and pressure passageway so that the amount of pressure in said pressure passageway can be ascertained;

a vacuum gauge;

means mounting the vacuum gauge rigidly to the barrel to establish communication between said vacuum gauge and vacuum passageway so that the amount of vacuum in the vacuum passageway can be ascertained.

5. The combination pressure producing and evacuation device according to claim 4 wherein said moving means comprises a head on said plunger that can be grasped by a user to selectively move the plunger in the first and second direction and said plunger is separable from said barrel upon being drawn in said second direction out of the open end of the barrel.

6. A combination pressure producing and evacuation device comprising:

a cylindrical barrel having an axially extending bore defining a chamber with a surrounding wall surface and spaced, axially opposite ends, said chamber being open at one of its axial ends and closed by a wall at its other axial end;

said barrel defining a vacuum passageway extending axially of a said barrel through said wall, communicating with said chamber and having an outlet;

said barrel defining a pressure passageway extending axially of said barrel through said wall, communicating with said chamber and having an outlet;

a first check valve;

means mounting the first check valve in the vacuum passageway so that air can flow into said chamber through said vacuum passageway but cannot flow out of said chamber through said vacuum passageway;

a second check valve;

means mounting the second check valve in the pressure passageway so that air can flow out of said chamber through said pressure passageway but cannot flow into said chamber through said pressure passageway;

a plunger for placement in the chamber through the open chamber end for movement axially of the barrel and having a cylindrical outer surface for making close sealing engagement with said chamber wall surface and flat surface facing said end wall; and means outside of said chamber to be grasped by the hand of a user for moving the plunger selectively in said first and second directions, whereupon movement of the plunger in a first axial direction moves the plunger face towards said end wall thereby compressing air in the chamber and the pressure passageway and movement of the plunger in a direction opposite to the first direction draws air from the chamber away from the end wall and evacuates the vacuum passageway.

7. The combination pressure producing and evacuation device according to claim 6 wherein said barrel is constructed from plastic.

8. The combination pressure producing and evacuation device according to claim 6 including a pressure gauge and a vacuum gauge, means mount the pressure gauge rigidly to the barrel so that the pressure gauge is in communication with the pressure passageway and means mount the vacuum gauge rigidly to the barrel so that the vacuum guage is in communication with the vacuum passageway, whereby the amount of pressure in the pressure passageway and vacuum in the vacuum passageway can be ascertained.

9. The combination pressure producing and evacuation device according to claim 8 wherein said barrel has a cylindrical outer surface, there is at least one flat on the outer surface to facilitate mounting at least one of said pressure and vacuum gauges and said one gauge has a portion directed radially of said barrel through said flat into communication with one of said pressure and vacuum passageways.

10. The combination pressure producing and evacuation device according to claim 6 wherein a fitting to attach a conduit is provided on the barrel in communication with at least one of the pressure and vacuum passageways.

* * * * *